US010076831B2

(12) United States Patent
Moore

(10) Patent No.: US 10,076,831 B2
(45) Date of Patent: Sep. 18, 2018

(54) BUFFER SYSTEM FOR HYDRAULIC HAMMER

(71) Applicant: Caterpillar Inc., Peoria, IL (US)

(72) Inventor: Cody T. Moore, Waco, TX (US)

(73) Assignee: Caterpillar Inc., Deerfield, IL (US)

( * ) Notice: Subject to any disclaimer, the term of this patent is extended or adjusted under 35 U.S.C. 154(b) by 425 days.

(21) Appl. No.: 14/864,110

(22) Filed: Sep. 24, 2015

(65) Prior Publication Data

US 2017/0087706 A1 Mar. 30, 2017

(51) Int. Cl.

| | |
|---|---|
| ***B25B 23/145*** | (2006.01) |
| ***B25D 17/06*** | (2006.01) |
| ***B25D 9/00*** | (2006.01) |
| ***B25D 17/24*** | (2006.01) |
| ***B25D 17/28*** | (2006.01) |
| ***E02F 3/96*** | (2006.01) |

(52) U.S. Cl.

CPC ..... *B25D 17/06* (2013.01); *B25D 9/00* (2013.01); *B25D 17/24* (2013.01); *B25D 17/28* (2013.01); *E02F 3/966* (2013.01); *B25D 2250/105* (2013.01); *B25D 2250/121* (2013.01); *B25D 2250/155* (2013.01)

(58) Field of Classification Search

CPC ..... B25D 17/24; B25D 9/00; B25D 17/06; B25D 2217/0019; B25D 2222/57; B25D 2250/101; B25D 2250/155; B25D 1/12; B25D 2250/051

USPC ..... 173/20, 162.1–162.2, 210–211

See application file for complete search history.

(56) References Cited

U.S. PATENT DOCUMENTS

| | | | | |
|---|---|---|---|---|
| 3,587,516 | A | 6/1971 | Wainscott | |
| 4,117,985 | A * | 10/1978 | Lazareck | B02C 13/28 241/197 |
| 4,269,275 | A | 5/1981 | Cousin | |
| 4,409,874 | A * | 10/1983 | Nitschmann | B27B 33/141 83/522.27 |
| 5,092,529 | A * | 3/1992 | Bechler | B02C 13/28 241/192 |
| 5,411,113 | A * | 5/1995 | Lubinski | E04G 7/22 182/186.7 |
| 6,095,257 | A * | 8/2000 | Lee | B25D 17/24 173/162.1 |

(Continued)

FOREIGN PATENT DOCUMENTS

| | | |
|---|---|---|
| AU | 2010100656 | 7/2010 |
| WO | 2010132936 | 11/2010 |

(Continued)

*Primary Examiner* — Robert Long

(74) *Attorney, Agent, or Firm* — Miller, Matthias & Hull

(57) ABSTRACT

A buffer system for a hydraulic hammer is disclosed. The buffer system includes a wear member disposed between a first component and a second component. The wear member includes a first surface. The first surface is adapted to abut an inner surface of the first component. The wear member also includes a second surface distal to the first surface. The second surface is adapted to abut an outer surface of the second component. The buffer system also includes an insert member disposed in the wear member between the first surface and the second surface thereof. The insert member provides a visual indication when a predefined thickness of the wear member between the first surface and the second surface is worn.

20 Claims, 5 Drawing Sheets

(56) References Cited

U.S. PATENT DOCUMENTS

| | | | | |
|---|---|---|---|---|
| 7,363,840 | B1 * | 4/2008 | Farley | B25B 23/0035 403/324 |
| 7,628,222 | B2 * | 12/2009 | Yoshimura | E04G 23/082 173/162.1 |
| 8,146,677 | B2 * | 4/2012 | Kim | B25D 17/00 173/115 |
| 8,672,052 | B2 * | 3/2014 | Nickels | E02F 3/966 173/128 |
| 8,955,616 | B2 | 2/2015 | Ostensson | |
| 2005/0236324 | A1 * | 10/2005 | Mildren | B04C 5/08 210/512.1 |
| 2006/0213676 | A1 * | 9/2006 | Jinnings | E02D 7/10 173/184 |
| 2009/0095574 | A1 * | 4/2009 | Romo | B66B 11/08 187/264 |
| 2011/0005786 | A1 * | 1/2011 | Ostensson | B25D 11/005 173/20 |
| 2012/0152581 | A1 * | 6/2012 | Pillers, II | E02F 3/966 173/162.1 |
| 2014/0102740 | A1 * | 4/2014 | Jagdale | E02F 3/966 173/114 |
| 2014/0208575 | A1 * | 7/2014 | Jagdale | E02F 3/966 29/525.02 |
| 2015/0041168 | A1 * | 2/2015 | Dostinov | B25D 17/20 173/90 |
| 2016/0303728 | A1 * | 10/2016 | Chapagain | B25D 17/24 |
| 2017/0113337 | A1 * | 4/2017 | Dostinov | B25D 9/04 |

FOREIGN PATENT DOCUMENTS

| | | |
|---|---|---|
| WO | 2012082872 | 6/2012 |
| WO | 2012135002 | 10/2012 |

* cited by examiner

BUFFER SYSTEM FOR HYDRAULIC HAMMER

TECHNICAL FIELD

The present disclosure relates to a buffer system, and more particularly to a wear member associated with the buffer system of a hydraulic hammer.

BACKGROUND

Hydraulic hammers include wear members that are provided between various components, such as a housing member and a power cell of the hydraulic hammer as a buffer material. The wear members act as sacrificial material, and prevent the components of the hydraulic hammer from being subjected to wear and abrasion. The wear members are subjected to extensive wear during an operation of the hydraulic hammer.

When the wear members wear out beyond a predefined wear limit, the wear members may require immediate replacement to avoid wear and abrasion of the components of the hydraulic hammer. Maintenance operator at customer's end may have to refer to service manuals to check the predefined wear limits of the wear members. However, this method of inspecting a condition of the wear member is time consuming and is prone to errors.

U.S. Pat. No. 3,587,516 describes a wear indicator. The wear indicator is provided in a plate structure, for instance, a planting plate. The wear indicator is mounted on the surface opposite to that which is exposed to a wearing environment. The wear indicator is strategically located to encounter the greatest wear or erosion such that after a preselected thickness of material has been worn away, a hole will appear to visually indicate that the plate has worn beyond prescribed limits.

SUMMARY OF THE DISCLOSURE

In one aspect of the present disclosure, a buffer system for a hydraulic hammer is provided. The buffer system includes a wear member disposed between a first component and a second component. The wear member includes a first surface. The first surface is adapted to abut an inner surface of the first component. The wear member also includes a second surface distal to the first surface. The second surface is adapted to abut an outer surface of the second component. The buffer system also includes an insert member disposed in the wear member between the first surface and the second surface thereof. The insert member provides a visual indication when a predefined thickness of the wear member between the first surface and the second surface is worn.

In another aspect of the present disclosure, a hydraulic hammer is provided. The hydraulic hammer includes a housing member. The hydraulic hammer also includes a power cell disposed within the housing member. The hydraulic hammer also includes a buffer system disposed between the housing member and the power cell. The buffer system also includes a wear member. The wear member includes a first surface. The first surface is adapted to abut an inner surface of the housing member. The wear member also includes a second surface distal to the first surface. The second surface is adapted to abut an outer surface of the power cell. The buffer system also includes an insert member disposed in the wear member between the first surface and the second surface thereof. The insert member provides a visual indication when a predefined thickness of the wear member between the first surface and the second surface is worn.

In yet another aspect of the present disclosure, a buffer system for a hydraulic hammer is provided. The buffer system includes a wear member disposed between the housing member and the power cell. The wear member is adapted to provide a clearance fit between the housing member and the power cell. The buffer system also includes an insert member disposed in the wear member. The insert member provides a visual indication when a predefined thickness of the wear member is worn. The insert member is molded to the wear member.

Other features and aspects of this disclosure will be apparent from the following description and the accompanying drawings.

DETAILED DESCRIPTION

Figure 1:
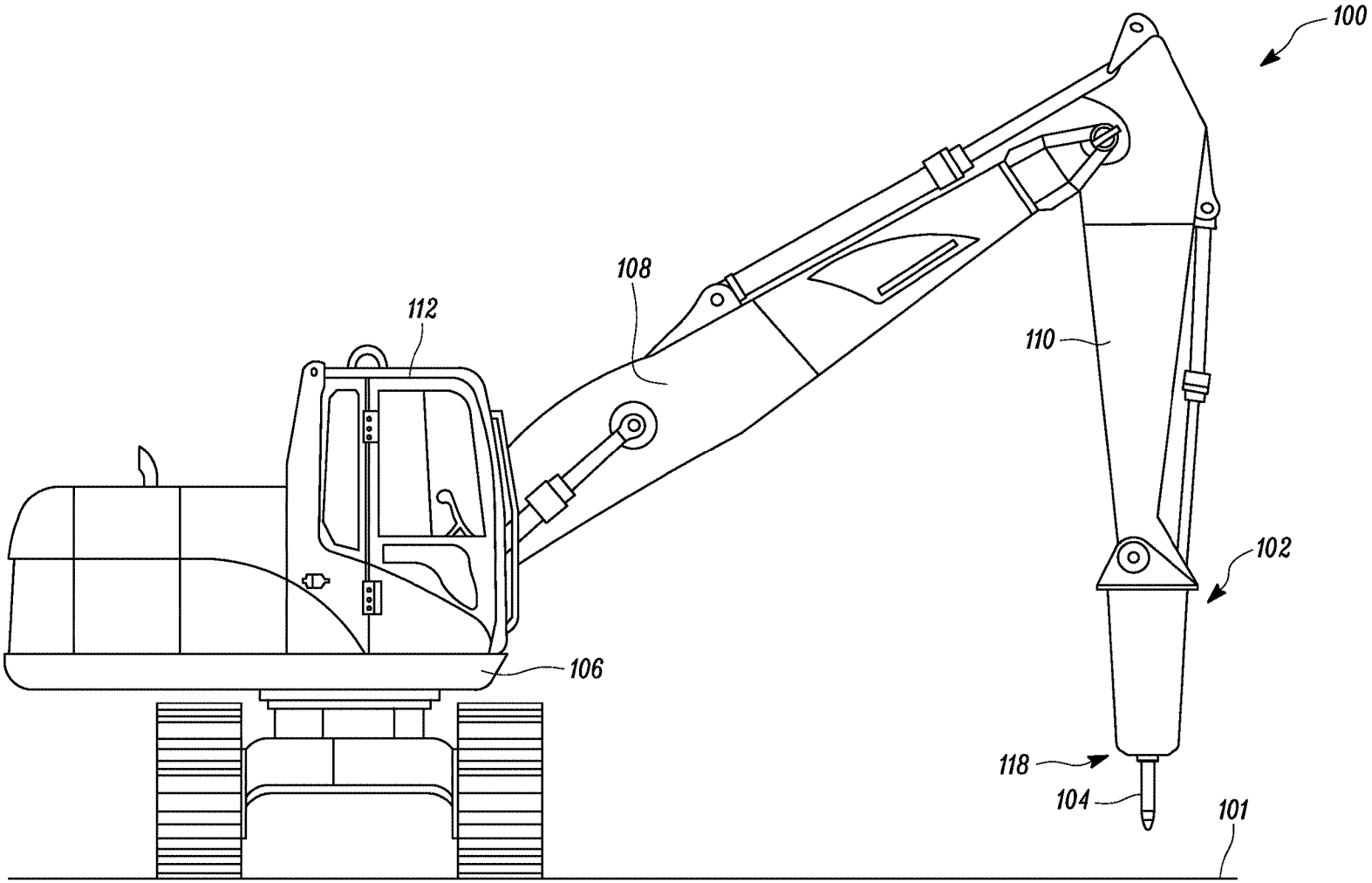
FIG. 1 is a schematic side view of an exemplary machine having a hydraulic hammer attached thereto, according to one embodiment of the present disclosure.

Wherever possible, the same reference numbers will be used throughout the drawings to refer to the same or the like parts. Referring to FIG. 1, an exemplary machine 100 is depicted. The machine 100 is embodied as a tracked drill machine. The machine 100 employs a hydraulic hammer 102, according to one embodiment of the present disclosure. The hydraulic hammer 102 includes a tool 104 for breaking rocks and penetrating ground surfaces. In one example, the hydraulic hammer 102 may be operated by the machine's hydraulic system. Alternatively, the hydraulic hammer 102 may be operated by the machine's pneumatic system. Further, it can be contemplated to use other types of machines and carriers to power the hydraulic hammer 102 of the present disclosure.

The machine 100 includes a frame 106, a boom member 108, and a stick member 110. The boom member 108 and the stick member 110 articulate relative to the frame 106 in order to change an orientation and/or position of the hydraulic hammer 102 with respect to a ground surface 101. The machine 100 includes input devices (not shown) located within a cab 112 of the machine 100. The input devices may be used by an operator to operate the hydraulic hammer 102.

Figure 2:
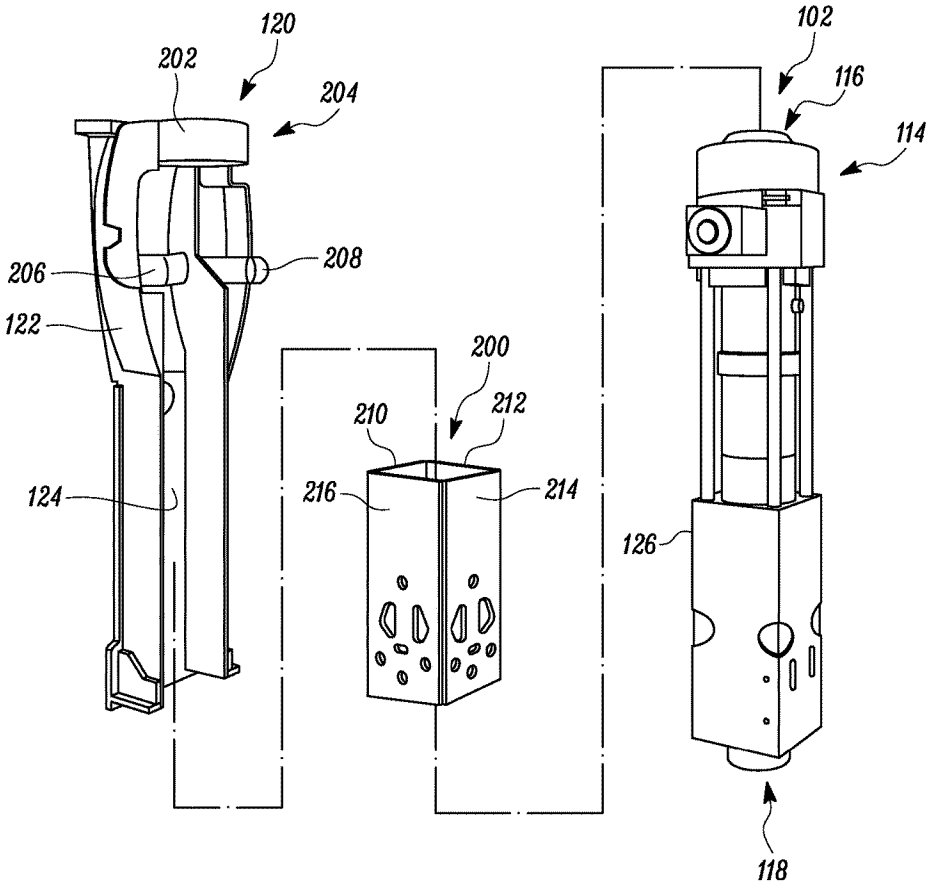
FIG. 2 is an exploded view of the hydraulic hammer showing a buffer system, according to one embodiment of the present disclosure.

FIG. 2 illustrates an exploded view of the hydraulic hammer 102, according to one embodiment of the present disclosure. The hydraulic hammer 102 includes a second component 114, hereinafter referred to as the power cell 114. The power cell 114 has a first end 116 and a second end 118. The first end 116 of the power cell 114 is configured to receive pressurized fluid during hammering. Further, the second end 118 of the power cell 114 is coupled to the tool 104. More particularly, one end of the tool 104 is received into the power cell 114 adjacent to the second end 118 (see FIG. 1).

The power cell 114 drives the tool 104 of the hydraulic hammer 102 so that the tool 104 may perform functions that are consistent with the present disclosure. The hydraulic hammer 102 includes a first component 120, hereinafter referred to as the housing member 120. A cut sectional view of the housing member 120 is shown in FIG. 2. The housing member 120 is coupled to and surrounds the power cell 114. The housing member 120 includes a first side plate 122 and a second side plate. For clarity purposes, only the first side plate 122 is shown in FIG. 2. The first side plate 122 and the second side plate may be aligned to receive mechanical fasteners, such as bolts. The mechanical fasteners couple the first side plate 122 with the second side plate.

In operation, the power cell 114 is subjected to impact loads due to contact of the tool 104 with the ground surface 101 and hardness thereof. Such impact loads, if transferred to the hydraulic hammer 102, may cause wear and tear of various components of the hydraulic hammer 102, such as the housing member 120 and the power cell 114. In order to avoid any direct contact between the power cell 114 and the housing member 120, the hydraulic hammer 102 includes a buffer system 200 disposed between the power cell 114 and the housing member 120. The buffer system 200 isolates the housing member 120 from the power cell 114. Further, the buffer system 200 also protects inner surfaces of the housing member 120 from wear by presenting a sacrificial surface.

In one example, the buffer system 200 includes an upper wear member 202. The upper wear member 202 is provided near an upper end 204 of the housing member 120. The upper wear member 202 is disc shaped. The buffer system 200 also includes a pair of side wear members 206, 208. The side wear members 206, 208 are provided between the power cell 114 and the housing member 120. In one example, the side wear members 206, 208 may be oblong in shape. In another example, the side wear members 206, 208 may be rectangular in shape.

The buffer system 200 also includes a number of wear members 210, 212, 214, 216. The wear members 210, 212, 214, 216 are disposed between the housing member 120 and the power cell 114. The wear members 210, 212, 214, 216 are embodied as plates having a rectangular shape. However, the wear members 210, 212, 214, 216 may have a different shape, without any limitations. Each of the wear members 210, 212, 214, 216 is inserted between the housing member 120 and the power cell 114. In one embodiment, the wear members 210, 212, 214, 216 may be held between the housing member 120 and the power cell 114 by an interference fit between the wear members 210, 212, 214, 216. In other embodiments, the wear members 210, 212, 214, 216 may be coupled to each other using fastening members, such as bolts and nuts. The wear members 210, 212, 214, 216 may be made of any metal or non-metal known in the art. In one example, the wear members 210, 212, 214, 216 are made of urethane, without limiting the scope of the present disclosure. In another example, the wear members 210, 212, 214, 216 may be made from nylon and ultra-high-molecular-weight polyethylene (UHMW). Although the buffer system 200 shown in the accompanying figures includes four wear members 210, 212, 214, 216, a number of wear members may vary as per operational specifications. For example, the buffer system 200 may include eight wear members, without any limitations.

Figure 3:
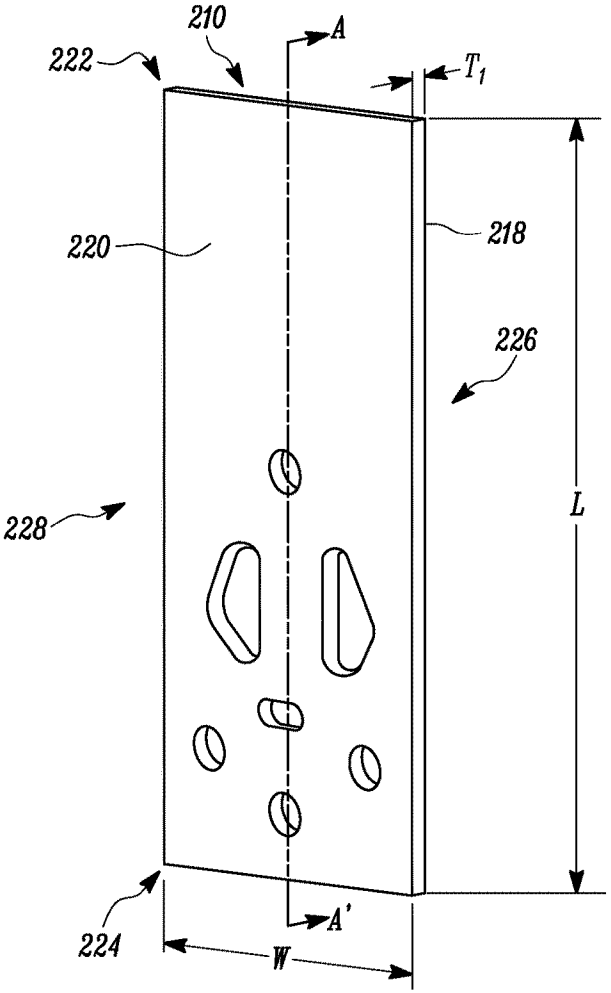
FIG. 3 is a perspective view of a wear member of the buffer system, according to one embodiment of the present disclosure.
Figure 4:
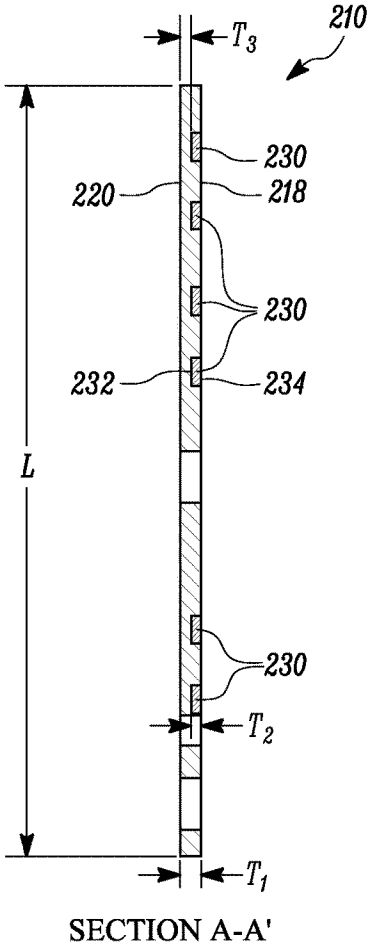
FIG. 4 is a sectional view of the wear member taken along line A-A' of FIG. 3.

For exemplary purposes, the wear member 210 will be described in detail herein with respect to FIGS. 3 and 4. However, it should be noted that the description provided, is equally applicable to the wear members 212, 214, 216 of the buffer system 200. Referring to FIGS. 3 and 4, the wear member 210 includes a first surface 218. The first surface 218 is adapted to abut an inner surface 124 (shown in FIG. 2) of the housing member 120. In the embodiment illustrated herein, the wear member 210 abuts the inner surface 124 of the first side plate 122. The wear member 210 also includes a second surface 220. The second surface 220 is adapted to abut an outer surface 126 (shown in FIG. 2) of the power cell 114. The second surface 220 is distal to the first surface 218. The first and second surfaces 218, 220 of the wear member 210 define a first thickness "$T_1$" therebetween. The first thickness "$T_1$" provides a clearance fit between the housing member 120 and the power cell 114.

The wear member 210 includes a first end 222. The wear member 210 also includes a second end 224 distal from the first end 222. More particularly, the first and second ends 222, 224 of the wear member 210 are vertically spaced apart from each other, such that a length "L" of the wear member 210 is defined therebetween. Further, the wear member 210 includes a first side 226 and a second side 228. The second side 228 is distal from the first side 226. The first and second sides 226, 228 are horizontally spaced apart from each other. A width "W" of the wear member 210 is defined between the first and second sides 226, 228 of the wear member 210.

An insert member 230 is disposed in the wear member 210 between the first surface 218 and the second surface 220. Further, the insert member 230 extends between the first and second sides 226, 228 of the wear member 210. More particularly, a number of insert members 230 may be disposed between the first end 222 and the second end 224 of the wear member 210. Referring to FIG. 4, the wear member 210 includes five insert members 230. However, the number of insert members 230 associated with a single wear member 210 may vary based on various parameters including, but not limited to, a length 'L' of the wear member 210 extending between the first end 222 and the second end 224, and the first thickness "$T_1$". In one example, each of the insert members 230 may be disposed at an equal distance with reference to adjacent insert members 230. In another example, a distance between two adjacent insert members 230 may vary. The location of each of the insert members 230 shown in the accompanying figures is exemplary. More particularly, the insert members 230 may be disposed at different locations along the length "L" of the wear member 210. The insert member 230 provides a visual indication to operator regarding a worn out condition of the wear member 210. In the illustrated embodiment, each of the insert members 230 has a rectangular cross section. In other embodiments, each of the insert members 230 may have a square cross section, a circular cross section, an elliptical cross section, a rectangular cross section, a polygonal cross section or any other cross section known in the art. A length "1" (shown in FIG. 5) of the insert member 230 is approximately equal to or less than the width "W" of the wear member 210. Alternatively, the length "1" of the insert member 230 may be different than the length "1" of another insert member 230. In another embodiment, one or more of insert members having a length equal to the length "L" of the wear member 210 may be disposed between the first end 222 and the second end 224. The insert member 230 may be made of any metal or non-metal known in the art. In one example, the insert member 230 may be made of metals, such as aluminum, steel, iron, and the like. In another example, the insert member 230 may be made of non-metals, such as ceramics or polymers.

The insert member 230 includes a top surface 232. The top surface 232 is positioned adjacent to and parallel to the second surface 220 of the wear member 210. The insert member 230 also includes a bottom surface 234 distal to the top surface 232. A second thickness "$T_2$" of the insert member 230 is defined between the top and bottom surfaces 232, 234 of the insert member 230. The second thickness "$T_2$" of the insert member 230 is less than the first thickness "$T_1$" of the wear member 210. Further, a predefined thickness "$T_3$" is defined between the top surface 232 of the insert member 230 and the second surface 220 of the wear member 210. The cross section of the insert member 230 may be defined based on the first thickness "$T_1$" and the predefined thickness "$T_3$" to be defined in the wear plate 210. In some examples, the thickness "T2" of one insert member 230 may be different from the thickness "T2" of another insert member 230. In an embodiment, the top surface 232 of the insert member 230 is one of a circular shape, an elliptical shape and a polygonal shape.

Figure 5:
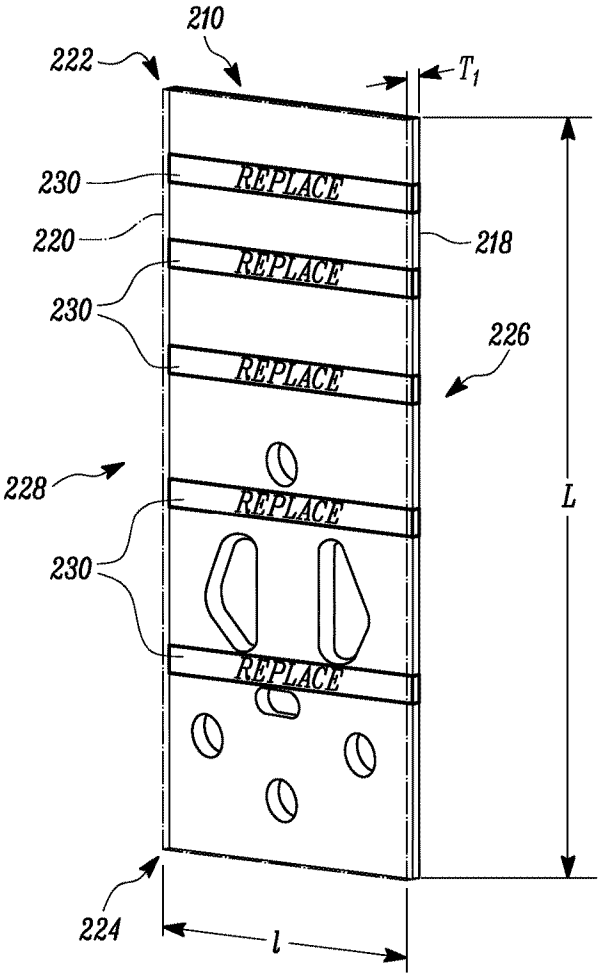
FIG. 5 is a perspective view of the wear member in a worn out condition, according to one embodiment of the present disclosure.

FIG. 5 illustrates a perspective view of the wear member 210 in a worn condition. The insert members 230 are visible as the wear member 210 is worn beyond a predefined thickness "$T_3$" (shown in FIG. 4). The insert member 230 is visible to the operator when the predefined thickness "$T_3$" of the wear member 210 defined between the first surface 218 and the second surface 220 is worn. The term predefined thickness "$T_3$" referred to herein is the thickness defined between the second surface 220 of the wear member 210 and the top surface 232 of the insert member 230.

In an embodiment of the present disclosure, the insert member 230 includes a warning mark 236 defined on the top surface 232 thereof. When the predefined thickness "$T_3$" of the wear member 210 wears, the warning mark 236 becomes visible to the operator. The visibility of the warning mark 236 may be an indication of a maximum wear limit of the wear member 210. The maximum wear limit may be further defined as a minimum thickness of the wear member 210 required for productive operation of the hydraulic hammer 102. In various embodiments, the warning mark 236 may include, but not limited to, a word, a alphabet, a numeric and a color mark. In another example, the words, alphabets, numeric, or alphanumeric may be engraved or carved in the insert members 230. Further, the insert members 230 may also include decal, or any other mark known in the art for indicating the operator to replace the wear member 210.

As and when the warning mark 236 on the insert member 230 becomes visible, the operator may be notified of the worn condition of the wear member 210. In one example, a word such as "REPLACE" may be written over the insert member 230. The word "REPLACE" may provide an indication of the worn condition of the wear member 210 to the operator. In another example, the insert members 230 may be painted. For example, the insert member 230 may be painted using a red color, so that the insert member 230 may be readily distinguished from the rest of the wear member 210 to provide wear indication.

The insert member 230 is molded with the wear member 210 during manufacturing of the wear member 210. For example, the insert member 230 may be provided in a mold during a molding process of the wear member 210, such that the insert member 230 is completely surrounded by the material of the wear member 210. More particularly, the insert member 230 may be introduced in the mold before molding the second surface 220 of the wear member 210, such that the predefined thickness "$T_3$" is defined between the top surface 232 of the insert member 230 and the second surface 220 of the wear member 210. Alternatively, any other process may be employed to dispose the insert member 230 in the wear member 210, without limiting the scope of the present disclosure.

INDUSTRIAL APPLICABILITY

When the hydraulic hammer 102 operates, the components of the hydraulic hammer 102 are subjected to impact loads due to the contact of the tool 104 of the power cell 114 with the ground surface. The present disclosure relates to the hydraulic hammer 102 having the buffer system 200. The buffer system 200 includes the number of wear members 210, 212, 214, 216. The wear members 210, 212, 214, 216 are subjected to impact loads that are transmitted to the wear members 210, 212, 214, 216, via the tool 104.

The wear members 210, 212, 214, 216 act as a sacrificial component. The wear members 210, 212, 214, 216 include the insert members 230 molded into the wear members 210, 212, 214, 216. The insert members 230 are completely surrounded by the wear members 210, 212, 214, 216. After a prolonged operation of the hydraulic hammer 102, the wear members 210, 212, 214, 216 wear out to a thickness that is greater than the predefined thickness "$T_3$", such that the insert members 230 are visible. The insert members 230 visually indicate that the respective wear member 210, 212, 214, 216 has worn beyond the predetermined wear limit. Accordingly, the operator, such as a maintenance operator, is notified that the wear members 210, 212, 214, 216 may have to be replaced.

The buffer system 200 disclosed herein acts as a wear indicator, and provides a cost effective and easy to implement solution for wear indication. The buffer system 200 allows visual inspection of a condition of the wear member 210, 212, 214, 216, thereby eliminating requirement of costly and time consuming indication apparatus.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A buffer system for a hydraulic hammer, the buffer system comprising:

a wear member including at least one plate that is disposed between a housing member and a power cell of the hydraulic hammer, the wear member comprising:

a first surface of the at least one plate configured to abut an inner surface of the housing member; and a second surface of the at least one plate distal to the first surface, the second surface configured to abut an outer surface of the power cell; and an insert member disposed in the at least one plate of the wear member and extending between the first surface and the second surface of the at least one plate thereof, wherein the insert member provides a visual indication when a predefined thickness of the wear member between the first surface and the second surface is worn.

2. The buffer system of claim 1, wherein the wear member comprises a first thickness extending between the first surface and the second surface, wherein the first thickness is configured to provide a clearance fit between the housing member and the power cell.

3. The buffer system of claim 1, wherein the wear member comprises:

a first end and a second end distal from the first end, and wherein the wear member defines a length extending between the first end and the second end thereof; and a first side and a second side distal from the first side, the first side and the second side extending between the first end and the second end, and wherein the wear member defines a width extending between the first side and the second side.

4. The buffer system of claim 3, wherein the insert member defines a length equal to or less than the width of the wear member.

5. The buffer system of claim 2, wherein the insert member defines a second thickness lesser than the first thickness of the wear member.

6. The buffer system of claim 5, wherein insert member comprises:

a top surface disposed adjacent to the second surface of the wear member; and a bottom surface distal to the top surface, the bottom surface disposed adjacent to the first surface of the wear member, wherein the top surface of the insert member is disposed within the wear member at the predefined thickness with reference to the second surface of the wear member, and wherein the second thickness of the insert member is defined between the top surface and the bottom surface thereof.

7. The buffer system of claim 6, wherein the top surface of the insert member is one of a circular shape, an elliptical shape and a polygonal shape.

8. The buffer system of claim 6, wherein the insert member comprises a warning mark defined on the top surface thereof to indicate replacement of the wear member to an operator.

9. The buffer system of claim 1, wherein the insert member is molded to the wear member during manufacturing of the wear member.

10. A hydraulic hammer comprising:

a housing member;

a power cell disposed within the housing member; and a buffer system disposed between the housing member and the power cell, the buffer system comprising:

a wear member including at least one plate that is disposed between the housing member and the power cell, the wear member comprising:

a first surface of the at least one plate configured to abut an inner surface of the housing member; and a second surface of the at least one plate distal to the first surface, the second surface configured to abut an outer surface of the power cell; and an insert member disposed in the wear member between the first surface and the second surface thereof, wherein the insert member provides a visual indication when a predefined thickness of the wear member between the first surface and the second surface is worn.

11. The hydraulic hammer of claim 10, wherein the wear member comprises a first thickness extending between the first surface and the second surface, wherein the first thickness is configured to provide a clearance fit between the housing member and the power cell.

12. The hydraulic hammer of claim 10, wherein the wear member comprises:

a first end and a second end distal from the first end, and wherein the wear member defines a length extending between the first end and the second end thereof; and a first side and a second side distal from the first side, the first side and the second side extending between the first end and the second end, and wherein the wear member defines a width extending between the first side and the second side.

13. The hydraulic hammer of claim 12, wherein the insert member defines a length equal to or less than the width of the wear member.

14. The hydraulic hammer of claim 11, wherein the insert member defines a second thickness lesser than the first thickness of the wear member.

15. The hydraulic hammer of claim 14, wherein insert member comprises:

a top surface disposed adjacent to the second surface of the wear member; and a bottom surface distal to the top surface, the bottom surface disposed adjacent to the first surface of the wear member, wherein the top surface of the insert member is disposed within the wear member at the predefined thickness with reference to the second surface of the wear member, and wherein the second thickness of the insert member is defined between the top surface and the bottom surface thereof.

16. The hydraulic hammer of claim 15, wherein the top surface of the insert member is one of a circular shape, an elliptical shape and a polygonal shape.

17. The hydraulic hammer of claim 15, wherein the insert member comprises a warning mark defined on the top surface thereof to indicate replacement of the wear member to an operator.

18. The hydraulic hammer of claim 10, wherein the insert member is molded to the wear member during manufacturing of the wear member.

19. A buffer system for a hydraulic hammer comprising a housing member and a power cell disposed within the housing member, the buffer system comprising:

a wear member including at least one plate that is disposed between the housing member and the power cell, the wear member configured to provide a clearance fit between the housing member and the power cell; and an insert member disposed in the at least one plate of the wear member, wherein the insert member provides a visual indication when a predefined thickness of the wear member is worn, and wherein the insert member is molded to the wear member.

20. The buffer system of claim 19, wherein the wear member comprises a first thickness, and wherein the insert member comprises a second thickness lesser than the first thickness of the wear member.

* * * * *